US009911276B2

(12) United States Patent
Borissov et al.

(10) Patent No.: US 9,911,276 B2
(45) Date of Patent: Mar. 6, 2018

(54) UNIVERSAL JACKPOT CONTROLLER FOR GAMING DEVICES AND GAMING SYSTEMS

(71) Applicants: Milo Borissov, Dubai Sports City (AE); Rossi McKee, Indianapolis, IN (US)

(72) Inventors: Milo Borissov, Dubai Sports City (AE); Rossi McKee, Indianapolis, IN (US)

( * ) Notice: Subject to any disclaimer, the term of this patent is extended or adjusted under 35 U.S.C. 154(b) by 152 days.

(21) Appl. No.: 14/610,795

(22) Filed: Jan. 30, 2015

(65) Prior Publication Data

US 2015/0243137 A1 Aug. 27, 2015

Related U.S. Application Data

(60) Provisional application No. 61/934,925, filed on Feb. 3, 2014.

(51) Int. Cl.
*G07F 17/00* (2006.01)
*G07F 17/32* (2006.01)

(52) U.S. Cl.
CPC ..... *G07F 17/3258* (2013.01); *G07F 17/3225* (2013.01); *G07F 17/329* (2013.01)

(58) Field of Classification Search
CPC ..... G07F 17/3258
See application file for complete search history.

(56) References Cited

U.S. PATENT DOCUMENTS

| | | | | |
|---|---|---|---|---|
| 5,280,909 | A | 1/1994 | Tracy | |
| 5,941,773 | A | 8/1999 | Harlick | |
| 6,110,043 | A | 8/2000 | Olsen | |
| 6,319,125 | B1 * | 11/2001 | Acres | G07F 17/32 463/25 |
| 7,896,741 | B2 | 3/2011 | Kuehling et al. | |
| 7,934,993 | B2 | 3/2011 | Kuehling et al. | |
| 8,740,710 | B2 | 6/2014 | Kelly et al. | |
| 2002/0010013 | A1 * | 1/2002 | Walker | A63F 3/081 463/16 |
| 2002/0052230 | A1 * | 5/2002 | Martinek | G07F 17/32 463/10 |
| 2005/0261058 | A1 * | 11/2005 | Nguyen | G07F 17/32 463/40 |
| 2007/0184896 | A1 * | 8/2007 | Dickerson | G07F 17/32 463/25 |
| 2010/0120538 | A1 * | 5/2010 | DeWitt | G07F 17/32 463/42 |
| 2013/0090160 | A1 * | 4/2013 | Iyer | G07F 17/3258 463/27 |

* cited by examiner

*Primary Examiner* — Reginald Renwick
(74) *Attorney, Agent, or Firm* — Weide & Miller, Ltd.

(57) ABSTRACT

A universal jackpot controller permits jackpots to be implemented at unlimited combinations of gaming machines and systems, including different types of gaming devices and systems of different operators and including land-based and online systems.

8 Claims, 3 Drawing Sheets

UNIVERSAL JACKPOT CONTROLLER FOR GAMING DEVICES AND GAMING SYSTEMS

RELATED APPLICATION DATA

This application claims priority to U.S. Provisional Patent Application Ser. No. 61/934,925, filed Feb. 3, 2014.

FIELD OF THE INVENTION

The present invention relates to methods and devices for implementing jackpots at gaming machines and gaming systems.

BACKGROUND OF THE INVENTION

Gaming machines which offer wagering games often include the provision for a jackpot. The jackpot may be a large award which is offered at a particular machine in the event one or more particular outcomes are received at that gaming machine.

However, a jackpot may be associated with two or more gaming machines. By linking two or more gaming machines, jackpots may increase in value more quickly (such as where the jackpots are funded by a portion of wagers placed at the machines). Currently it is known to associate a jackpot controller with a bank of gaming machines. The jackpot controller is a computing device which is in communication with each of the gaming machines in the bank of machines. The jackpot controller monitors the play at each gaming machine, such as to detect wagers placed so that the jackpot can be incremented, or to award the jackpot to a player who receives a jackpot winning outcome at one of the machines.

Such a configuration is illustrated and described in U.S. Pat. No. 5,280,990. Unfortunately, however, this configuration is very inflexible. As illustrated in that patent, the jackpot system requires that the jackpot controller include individual interfaces (23A-D) for each and every gaming machine. This makes expansion of the jackpot system difficult. First, different types of gaming machines may not be connectable to the jackpot controller. Second, to add other gaming machines, the jackpot controller must be modified to include additional interfaces.

SUMMARY OF THE INVENTION

Embodiments of the invention comprise devices and methods for implementing one or more jackpots at gaming devices or gaming systems. One embodiment of the invention is a jackpot controller. The jackpot controller can be used to offer one or more jackpots at a gaming device or to a gaming system. As described herein, the jackpot controller may interface directly with one or more gaming devices and/or it may interface with one or more gaming systems.

Further objects, features, and advantages of the present invention over the prior art will become apparent from the detailed description of the drawings which follows, when considered with the attached figures.

DETAILED DESCRIPTION OF THE INVENTION

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

Embodiments of the invention comprise devices and methods for implementing one or more jackpots at gaming devices or gaming systems. One embodiment of the invention is a jackpot controller. The jackpot controller can be used to offer one or more jackpots at one or more gaming devices and/or to one or more gaming systems. As described herein, the jackpot controller may interface directly with one or more gaming devices and/or it may interface with one or more gaming systems.

Figure 1:
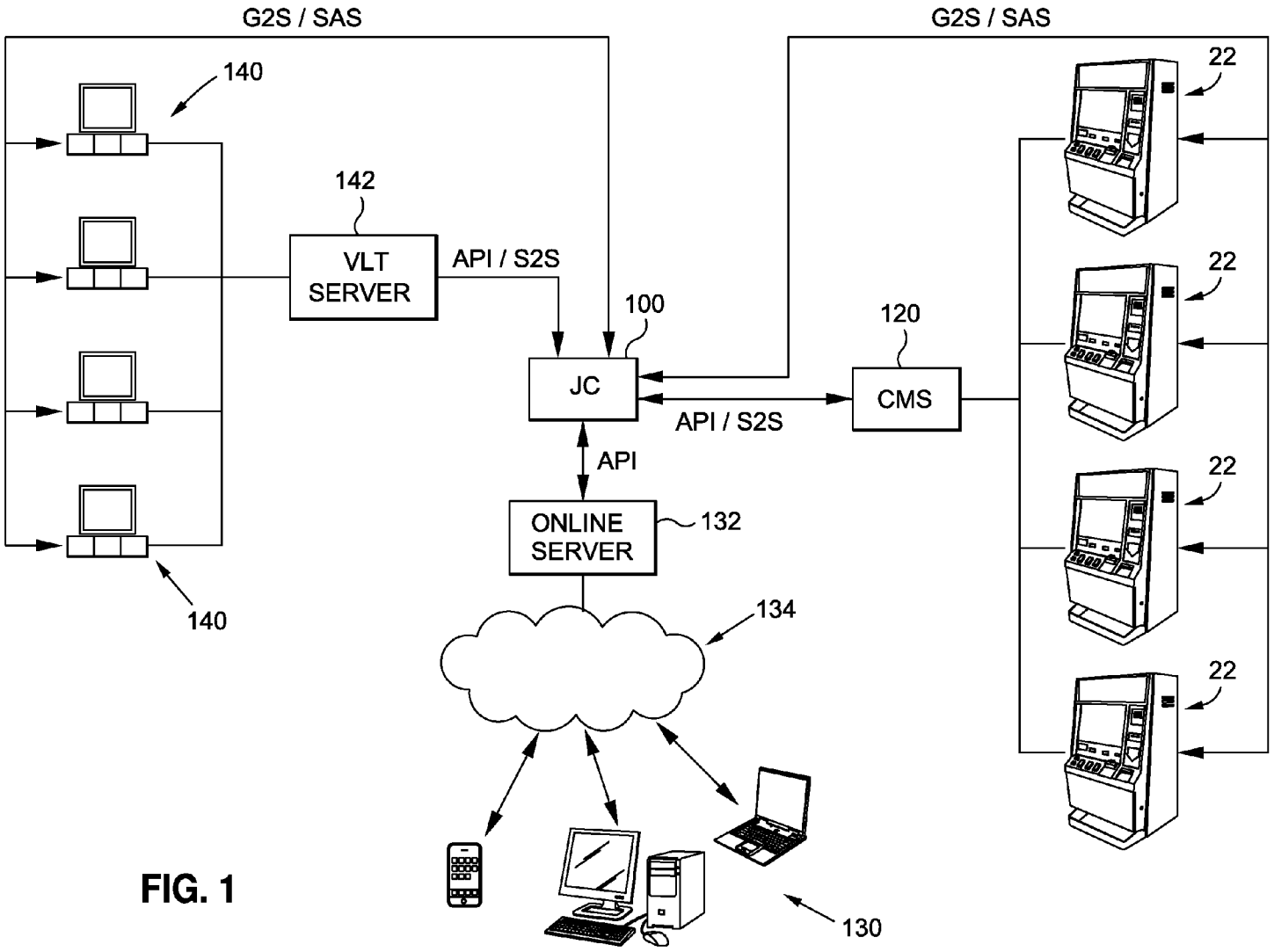
FIG. 1 schematically illustrates interaction of a jackpot controller of the present invention with different types of gaming devices and gaming systems.

FIG. 1 schematically illustrates interconnectivity of a jackpot controller 100 of the invention with various gaming devices and systems. For example, the jackpot controller 100 may directly interact or communicate with one or more gaming machines 22. Such a gaming machine 22 may have various configurations.

The gaming machine 22 may be located at a casino (and as such may be referred to as a "casino gaming machine"). As described below, the gaming machine 22 may be part of a gaming system, such as a casino gaming system which links two or more of the gaming machines or one or more gaming machines with other devices, such as one or more table games, kiosks, or the like, and a casino management system, such as an accounting system or server, player tracking system or server or the like.

Figure 3:
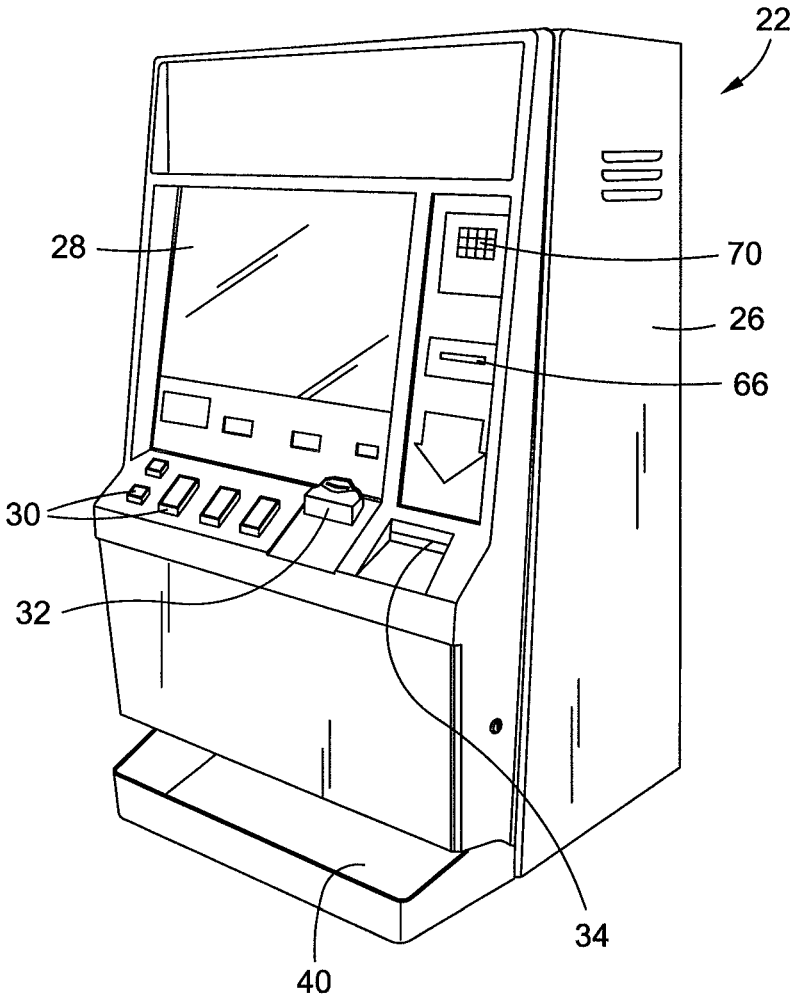
FIG. 3 illustrates an embodiment of a gaming machine to which the jackpot controller of the invention is applicable.

One configuration of a gaming machine 22 is illustrated in FIG. 3. As illustrated, the gaming machine 22 generally comprises a housing or cabinet 26 for supporting and/or enclosing various components required for operation of the gaming machine. In the embodiment illustrated, the housing 26 includes a door located at a front thereof, the door capable of being moved between an open position which allows access to the interior, and a closed position in which access to the interior is generally prevented. The configuration of the gaming machine 22 may vary. In the embodiment illustrated, the gaming machine 22 has an "upright" configuration. However, the gaming machine 22 could have other configurations, shapes or dimensions (such as being of a "slant"-type, "bar-top" or other configuration as is well known to those of skill in the art).

The gaming machine 22 preferably includes at least one display device 28 configured to display game information. The display device 28 may comprise an electronic video display such as a cathode ray tube (CRT), high resolution flat panel liquid crystal display (LCD), projection LCD, plasma display, field emission display, digital micro-mirror display (DMD), digital light processing display (DLP), LCD touch-screen, a light emitting display (LED) or other suitable displays now known or later developed, in a variety of resolutions, sizes and formats (e.g. 4:3, widescreen or the like). The display 28 may be capable of projecting or displaying a wide variety of information, including images, symbols and other indicia or information associated with game play, game promotion or other events. The gaming machine 22 might include more than one display device 28, such as two or more displays 28 which are associated with the housing 26. The gaming machine 22 might also include a top box or other portion. Such a top box might include one or more display devices 28, such as in addition to one or more main displays which are associated with the housing 26. Also, the gaming machine 22 might include side displays (such as mounted to the exterior of the housing 26) and might include multiple displays of differing sizes.

As described in more detail below, the gaming machine 22 is preferably configured to present one or more games upon a player making a monetary payment or wager. In this regard, as described in more detail below, the gaming machine 22 includes means for accepting monetary value.

In one embodiment, as detailed above, certain game outcomes may be designated as winning outcomes. Prizes or awards may be provided for winning outcomes, such as monetary payments (or representations thereof, such as prize of credits), or promotional awards as detailed herein. As detailed below, the gaming machine 22 includes means for returning unused monetary funds and/or dispensing winnings to a player.

The gaming machine 22 preferably includes one or more player input devices 30 (such as input buttons, plunger mechanisms, a touch-screen display, joystick, touch-pad or the like). These one or more devices 30 may be utilized by the player to facilitate game play, such as by providing input or instruction to the gaming machine 22. For example, such input devices 30 may be utilized by a player to place a wager, cause the gaming machine 22 to initiate a game, to indicate cards to be held or discarded, to "cash out" of the gaming machine, or to provide various other inputs.

In one preferred embodiment, the gaming machine 22 includes at least one microprocessor or controller for controlling the gaming machine, including receiving player input and sending output signals for controlling the various components of the machine 22 (such as generating game information for display by the display 28). The controller may be arranged to receive information regarding funds provided by a player to the gaming machine, receive input such as a purchase/bet signal when a purchase/bet button is depressed, and receive other inputs from a player. The controller may be arranged to generate information regarding a game, such as generating game information for display by the at least one display 28 (such as information representing images of displayed cards, slot symbols or the like), for determining winning or losing game outcomes and for displaying information regarding awards for winning game outcomes, among other things.

The controller may be configured to execute machine readable code or "software" or otherwise process information, such as obtained from a remote server. Software or other instructions may be stored on a memory or data storage device. The memory may also store other information, such as pay table information. The gaming machine 22 may also include one or more random number generators for generating random numbers, such as for use in selecting cards and for presenting the game in a random fashion.

Preferably, the controller is configured to execute machine readable code or instructions which are configured to implement the method of game play of the invention. For example, the controller of the gaming machine 22 may be configured to detect a wager, such as a signal from a player's depressing of the "bet one" button. Upon such an event and/or the player otherwise signaling the gaming machine to present the game, the controller may be configured to cause game data to be displayed on the at least one display 28. The controller may accept input from a player of game inputs via the one or more player input devices of the gaming machine 22.

The gaming machine 22 may be configured to generate and present games in a stand-alone manner or it may be in communication with one or more external devices at one or more times. For example, the gaming machine 22 may be configured as a server based device and obtain game code or game outcome information from a remote game server (in which event the gaming machine controller may receive game information from the server, such as game outcome information, and use that server-generated information to present the game at the gaming machine).

As indicated, the gaming machine 22 is configured to present one or more wagering games. Thus, the gaming machines 22 is preferably configured to accept value, such as in the form of coins, tokens, paper currency or other elements or devices representing value such as monetary funds. For example, as illustrated in FIG. 3, the gaming machine 22 might include a coin acceptor 32 for accepting coins. Of course, associated coin reading/verifying devices and coin storage devices may be associated with the gaming machine 22 if it is configured to accept coins. Likewise, the gaming machine 22 might include a media reader 34. Such a reader may be configured to accept and read/verify paper currency and/or other media such as tickets. Of course, in such event the gaming machine 22 may further be configured with one or more paper currency or ticket storage devices, such as cash boxes, and other paper currency or media handling devices (including transport devices).

The gaming machine 22 might also be configured to read FOBs, magnetic stripe cards or other media having data associated therewith and via which value or funds may be associated with the gaming machine 22.

In one embodiment, the gaming machine 22 is configured to award winnings for one or more winning wagering game outcomes. Such winnings may be represented as credits, points or the like. In one embodiment, the player may "cash out" and thus remove previously associated funds and any awarded winnings or such may otherwise be paid to the player. For example, upon an award or at cash-out, associated funds may be paid to the player by the gaming machine 22 dispensing coins to a coin tray. In another embodiment, funds may be issued by dispensing paper currency. In yet another embodiment, a player may be issued a media, such as a printed ticket, which ticket represents the value which was paid or cashed out of the machine. The aspects of gaming machine "ticketing" systems are well known. One such system is described in U.S. Pat. No. 6,048,269 to Burns, which is incorporated herein in its entirety by reference.

The gaming machine 22 may also include a player tracking device, such as a card reader 66 and associated keypad 70. Such player tracking devices are well known and may permit the game operator to track play of players of the gaming machine. The tracked play may be utilized to offer player bonuses or awards.

It will be appreciated that the gaming machine illustrated in FIG. 3 is only exemplary of one embodiment of a gaming machine. For example, it is possible to for the gaming machine to have various other configurations, including different shapes and styles and having different components than as just described. Such gaming machines may be referred to a spinning reel or "slot" machines (such as when configured to include spinning reel type displays or to display spinning reel type video information) or video gaming machines, and may be configured to implement a variety of games now known or later developed, including, but not limited to slot games, poker games, blackjack games, lotteries, bingo games, keno games, roulette games, baccarat games and others.

As one aspect of the invention, the jackpot controller 100 might communicate directly with one or more gaming machine(s) 22. For example, the gaming machines 22 may include one or more communication interfaces or ports and use proprietary, standard or open communication protocols using wired and/or wireless communication links or connections. For example, the gaming machines 22 might be configured to communicate using the known System to System ("S2S") or Slot Accounting System ("SAS") communication protocols. In such a configuration, the jackpot controller 100 might communicate with the gaming machines 22 using those protocols.

In one embodiment, one or more gaming machines 22 might be associated with a gaming or casino management system ("CMS"). Such a system may include a host or casino management server 120. The casino management host 120 may comprise one or more computing devices, such as servers, which are in communication with the gaming machines 22. The casino management host 120 may be configured to track game play at the gaming machines 22, tracking and manage game system accounting by monitoring monetary-related transactions at the gaming machines 22 (cash-in, wagers placed, winnings awarded, cash-outs, etc.), award promotions at the gaming machines, and/or implement other features.

In this configuration, the jackpot controller 100 might simply communicate with the casino management host 120 via one or more communication links. The jackpot controller 100 might communicate with the casino management host 120 in various manners, such as via an application program interface (API) or S2S or the like.

As illustrated in FIG. 1, the jackpot controller 100 might communicate with other types of gaming devices. For example, the gaming devices might comprise computing or presentation devices 130, such as a home or office computer or a player's mobile electronic device such as a PDA, phone or the like. In one embodiment, games may be presented at those devices 130 via one or more online game servers 132. For example, a player might log into a game server 132 and the controller thereof might cause game information to be delivered to the player's computing device 130 via a communication link. The communication link might comprise or include the Internet 134 and/or other networks, such as a wired or wireless LAN, or combinations of public and/or private networks including wired and/or wireless links. In such a configuration it will be noted that the term "controller" may comprise more than one device. For example, in a server-based environment, a controller at a server may generate game information and transmit that information to a local controller at a player's computing device. The local controller at the gaming machine or the player's computer or other electronic device may then cause game information to be displayed on one or more associated displays.

As illustrated in FIG. 1, the jackpot controller 100 might also communicate with video lottery terminals 140 or similar devices such as server-based casino game terminals. These terminals 140 may be display devices or computing devices which are configured to present video lottery games or display the outcomes of video lottery games, as is well known, or to present or display other types of games. The terminals 140 may include one or more communication ports or interfaces, much like the gaming machines 22. In this manner, the jackpot controller 100 may communicate directly with those devices, such as via Game to System ("G2S") or SAS standard protocols or other communication protocols.

The video lottery or server-based casino terminals 140 may be associated with one or more video lottery or casino-game servers 142. The video lottery or casino game servers 142 may be connected to the terminals 140 and be configured to enable or track the presentation of games at the terminals 140. In such a configuration, the jackpot controller 100 may be configured to communicate with the video lottery or casino game server 142 (and thus with the terminals 140 connected thereto). For example, the jackpot controller 100 might communicate with a video lottery or casino game server 142 using an application program interface or the S2S communication protocol.

Of course, the jackpot controller 100 might communicate with other types of gaming devices or gaming systems other than those described above, and may communicate with any variety of combinations of such devices and systems. Such devices might include live dealer tables or devices, automated game tables and other devices.

It will be appreciated that the various gaming systems and devices may be configured to present various games. In a preferred embodiment, the games are wager-based games, such as where money or monetary value credits, points or the like, must be wagered. However, the games could be other types of games, including entertainment games.

Figure 2:
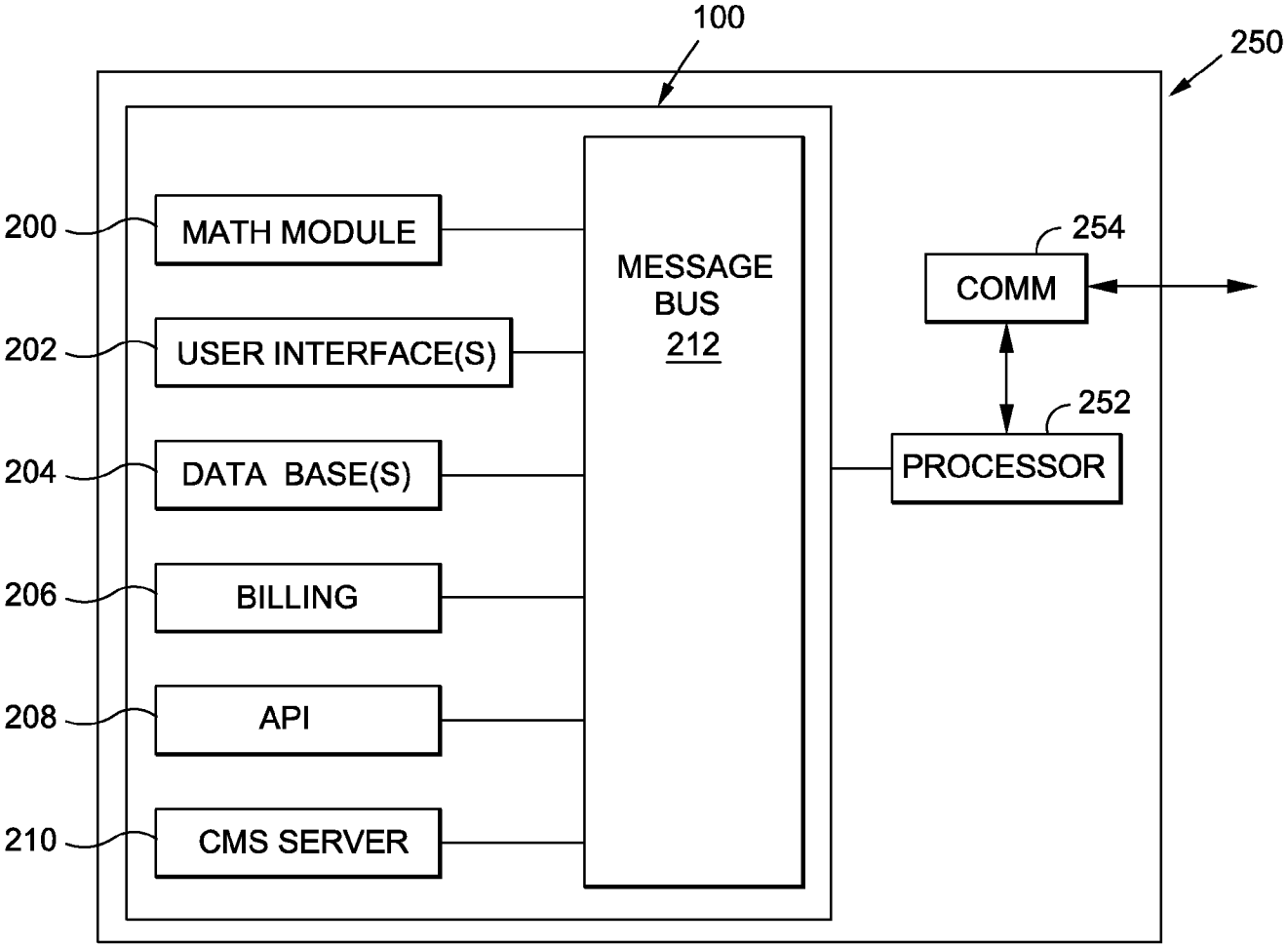
FIG. 2 schematically illustrates a jackpot controller in accordance with an embodiment of the invention.

One embodiment of a jackpot controller 100 of the invention is illustrated in FIG. 2. In one embodiment, the jackpot controller 100 may comprise machine readable or executable code which is stored in a tangible medium (i.e. software). Of course, aspects of the jackpot controller 100 may comprise or be implemented as hardware.

For example, an embodiment of the invention can be implemented as computer software in the form of computer readable code executed on a general purpose computer, or in the form of bytecode class files executable within a Java™ runtime environment running on such a computer, or in the form of bytecodes running on a processor (or devices enabled to process bytecodes) existing in a distributed environment (e.g., one or more processors on a network).

Such a computer 250 may include a video memory (not shown), a main memory (not shown) and a mass storage (not shown), all coupled to system bus (not shown) along with user inputs devices such as a keyboard and/or mouse (not shown), and one or more processors 252. The mass storage may include both fixed and removable media, such as magnetic, optical or magnetic optical storage systems or any other available mass storage technology. The system bus may contain, for example, thirty-two address lines for addressing video memory or main memory. The system bus also includes, for example, a 64-bit data bus for transferring data between and among the components, such as processor, main memory, video memory and mass storage. Alternatively, multiplex data/address lines may be used instead of separate data and address lines.

The computing device may also include a communication interface 254 coupled to the system bus. Communication interface 254 provides a two-way data communication with external systems and devices.

Application code may be embodied in any form of computer program product. A computer program product comprises a medium configured to store or transport computer readable code, or in which computer readable code may be embedded. Some examples of computer program products are CD-ROM disks, ROM cards, floppy disks, magnetic tapes, computer hard drives, servers on a network, and carrier waves. The computer systems described above are for purposes of example only. An embodiment of the invention may be implemented in any type of computer system or programming or processing environment.

As illustrated in FIG. 2, the jackpot controller 100 may comprise a math module 200. The math module may determine the configuration of the one or more jackpots. The module may, for example, permit the generation of different types of jackpots (fixed amounts, progressive amounts, jackpots on designated wins, mystery jackpots which are awarded for events or outcomes which are randomly determined or determined independent of game outcomes or the like, or other types of jackpots known to those of ordinary skill in the art and those which are newly developed). The module may manage the amounts of the jackpots (such as fixed or progressive value; base value for such jackpots), the contributions from the wagers at the gaming machines (such as to grow progressive jackpots) or other incrementing of the jackpot(s), and determine and monitor jackpot winning events (such as setting particular jackpot winning game outcomes or other jackpot winning outcomes such as levels of coin-in/wagers or other events), and determine the one or more winners of the jackpots (where a jackpot might be won by a player of a particular machine, by players of more than one machine—such as a group of machines, or shared by multiple players).

The jackpot controller 100 may also comprise a user interface module 202. This interface module 202 may implement one or more interfaces for monitoring and managing the jackpot controller. For example, the interface module 202 may implement one or more graphical user interfaces (GUIs) which are displayed on a user interface (such as a video display of an associated computing device or of a computing device which is accessing the jackpot controller, such as via the Internet). Such a GUI may permit a user to manage the jackpot controller to add machines or systems and and/or to group machines or systems relative to particular jackpots, to change jackpot triggering criteria, to set new jackpots, to determine jackpot levels, to monitor jackpot winning events or the like.

The jackpot controller 100 may also comprise one or more databases or database modules 204. The database modules may comprise or store data relating to the jackpots, such as jackpot criteria data, jackpot history data, jackpot amounts and other information. The database module may interface with one or more databases of information which are stored in one or more memory devices.

The jackpot controller 100 may also comprise a billing module 206. The billing module 406 may be used to track wagers applied to jackpots and awards of jackpots for billing purposes, such when different jackpots are implemented relative to gaming devices or systems which are operated by different operators or different jackpots are implemented relative to one operator.

The jackpot controller 100 may also comprise an API module 208. The API module 208 preferably implements a global or universal interface which permits communications between the jackpot controller 100 and all gaming devices and systems, regardless of their type or nature or their native communication protocol. As indicated herein, the API module 208 permits the jackpot controller 100 to communicate with CMS systems, VLT or server-based game systems, online game servers, media broadcast systems (such as video systems including one or more video displays, thus permitting the jackpot controller 100 to cause jackpot information to be displayed via those systems). The API is also a system to system integration layer. In this regard, the jackpot controller can "unify" two different gaming systems so as to implement a common jackpot across two or more different systems at the same time.

The jackpot controller 100 may also comprise a CMS server module 210. The CMS server module 210 is optional, but may be included in order to allow the jackpot controller 100 to act as a game or casino management server for a group of two or more gaming machines.

The jackpot controller 100 may also comprise a message bus or module 212. The message bus 212 preferably communicatively couples the different modules of the jackpot controller 100, permitting them to communicate or exchange information. The message bus 212 may also be the bridge for communications to external devices, such as via a communication interface of the computing device which is implementing the jackpot controller and the external gaming devices and systems.

Of course, the jackpot controller 100 might comprise other or different modules or elements than as described herein.

As indicated above, the jackpot controller 100 might be implemented on a computing device such as a computer or a server. That device might be in communication with various gaming devices and systems as illustrated in FIG. 1. In other embodiments, the jackpot controller 100 could actually be implemented on the servers or gaming devices themselves (for example, by installing the jackpot controller 100 on a video lottery or casino game server or gaming system server itself).

The universal jackpot controller of the invention has numerous advantages and features. For example, the jackpot controller is preferably implemented as a software module that offers the opportunity to create an unlimited number of virtual controllers and to set-up unlimited combinations of groups/combinations or "banks" gaming machines in a casino or virtual game space. The jackpot controller allows for the flexible establishment of multilevel mystery and progressive jackpots using different math and customizable settings. Networked jackpots and flexible settings for LAP and WAP may be offered.

Importantly, the jackpot controller of the invention is platform independent. The controller can work alone (connected directly to a gaming device or machine) or be connected to any gaming system, such as CMS platform, a VLT or server-based platform, online platform, or combinations thereof.

The jackpot controller of the invention permits the unification of land based gaming machines, VLT or server-based systems and terminals and online games, all relative to a common jackpot. In this manner, a single operator to link all of their gaming systems or devices, or the gaming machines or systems of different operators may be linked.

The jackpot controller permits independent from jackpot visualization. In particular, the controller can use or connect to any third party visualization system or media broadcast systems, thus providing flexible and easy broadcast of jackpot information.

The jackpot controller permits unlimited connection modes. The different connection modes can be used simultaneously and independently one of another:

(1) Directly to the gaming machines or VLT or server-based casino game terminals, such as via G2S or SAS (such as connected to such machines or terminals via a slot machine interface board ("SMIB") communication interface).

(2) Integration to CMS systems, such as via a simple API or S2S.

(3) Integration to a VLT or casino game server, such as via a simple API or S2S.

(4) Integration to an online casino platform, such as via a simple API (5) Integration to an online game server, such as via a simple API.

Of course, these are but examples of potential configurations of the jackpot controller.

It will be understood that the above described arrangements of apparatus and the method there from are merely illustrative of applications of the principles of this invention and many other embodiments and modifications may be made without departing from the spirit and scope of the invention as defined in the claims.

What is claimed is:

1. A gaming system including a universal jackpot controller, comprising:

a plurality of gaming machines which present wager-based games;

a casino management system comprising at least one casino management system server which communicates with said plurality of gaming machines;

a universal jackpot controller comprising a processor, a jackpot module comprising machine-readable code executable by said processor to implement one or more jackpots, and universal communication interface which permits communications in a plurality of protocols, said universal jackpot controller communicating directly with said casino management server via said universal communication interface in communications of a first protocol and communicating directly with said gaming machines via said universal communication interface in communications of a plurality of second protocols without the need for an intermediate gaming machine translator.

2. The gaming system in accordance with claim 1, wherein said universal jackpot controller communicates directly with at least one online game server via said communication interface in communications of a third protocol.

3. The gaming system in accordance with claim 1, wherein said universal jackpot controller further comprises machine-readable code executable by said processor to implement a plurality of virtual jackpot controllers, each of said plurality of jackpot controllers implementing one or more jackpots relative to one or more groups of gaming machines selected from said plurality of gaming machines.

4. The gaming system in accordance with claim 1, wherein said plurality of second protocols include G2S and SAS.

5. The gaming system in accordance with claim 1 wherein said first protocol comprises S2S.

6. The gaming system in accordance with claim 1 wherein said jackpot module implements a plurality of virtual jackpot controllers, each of said plurality of jackpot controllers implementing one or more jackpots relative to one or more groups of gaming machines selected from said plurality of different gaming machines.

7. The gaming system in accordance with claim 1 wherein said universal communication interface is implemented via an API module of said universal jackpot controller.

8. The gaming system in accordance with claim 7 wherein said API module comprises a system to system integration layer.

* * * * *